US006548007B1

(12) United States Patent
Deloris et al.

(10) Patent No.: US 6,548,007 B1
(45) Date of Patent: Apr. 15, 2003

(54) SURFACING DEVICE

(75) Inventors: Roger Deloris, Poigny la Foret (FR); Jean-Claude Dumont, Tonneville (FR); Thierry Duquesnoy, Les Essarts le Roi (FR)

(73) Assignee: Compagnie Generale des Matieres Nucleaires, Velizy-Villacoublay (FR)

( * ) Notice: Subject to any disclaimer, the term of this patent is extended or adjusted under 35 U.S.C. 154(b) by 0 days.

(21) Appl. No.: 09/554,961

(22) PCT Filed: Sep. 29, 1999

(86) PCT No.: PCT/FR99/02313

§ 371 (c)(1),
(2), (4) Date: May 22, 2000

(87) PCT Pub. No.: WO00/18553

PCT Pub. Date: Apr. 6, 2000

(30) Foreign Application Priority Data

Sep. 29, 1998 (FR) ..... 98 12138

(51) Int. Cl.[7] ..... B28B 1/29

(52) U.S. Cl. ..... 264/293; 267/333; 267/310; 425/218; 425/385; 425/470

(58) Field of Search ..... 264/333, 279.1, 264/267, 293, 310; 425/110, 127, 218, 426, 427, 428, 429, 385, 470

(56) References Cited

U.S. PATENT DOCUMENTS 3,579,755 A * 5/1971 Blankenhorn ..... 25/1 R
3,877,673 A * 4/1975 Bisinella et al. ..... 249/83
4,170,443 A 10/1979 Becker ..... 425/110
4,738,218 A * 4/1988 Toncelli ..... 118/111
5,205,669 A 4/1993 Neff ..... 404/97
5,449,406 A 9/1995 Presti, Jr. ..... 118/264

FOREIGN PATENT DOCUMENTS

| | | |
|---|---|---|
| DE | 842 777 | 6/1952 |
| EP | 0 218 136 | 9/1986 |
| FR | 2 693 399 | 7/1999 |
| GB | 1 487 833 | 10/1977 |

* cited by examiner

*Primary Examiner*—Jan H. Silbaugh
*Assistant Examiner*—Joseph S Del Sole
(74) *Attorney, Agent, or Firm*—Cohen, Pontani, Lieberman & Pavane

(57) ABSTRACT

The device comprises a moving assembly (24) designed to be placed in an operating position in which said assembly (24) is over the opening **(12*e*) of a receptacle (12) filled with a viscous material, first motor means (32) and a first guide system (30*a*, 34*a*, 42) serve to impart vertical translation movement to said assembly (24) relative to said receptacle (12), and variable-speed, second motor means (48) and a second guide system (54) serve to impart rotary motion to a moving subassembly (26) belonging to said assembly (24). Said subassembly (26) has a vertical shaft whose top portion (46*a*) is secured to said second motor means (48), and a rule (22) connected to the bottom portion (46*b*) of said shaft, the length of the rule being substantially equal to the radius of said opening (12*e*) and the rule having a bottom surface presenting a horizontal longitudinal portion designed to level the top surface (14*a*)** of the viscous material.

17 Claims, 3 Drawing Sheets

SURFACING DEVICE

PRIORITY CLAIM

This is a U.S. national stage of application No. PCT/FR99/02313, filed on Sep. 29, 1999. Priority is claimed on that application and on the following application(s): Country: France, Application No.: 98 12138, Filed: Sep. 29, 1998.

FIELD OF THE INVENTION

The invention relates to a surfacing device for making substantially plane the top surface of a viscous material contained in a receptacle, and it also relates to a surfacing method using such a device.

The term "surfacing" relates to surface finishing, i.e. to the operation which consists in making plane the surface of a viscous material such as concrete or cement.

BACKGROUND OF THE INVENTION

In the prior art, a surfacing operation is performed by hand with a tool that has a plane surface (a rule or a trowel), with the tool being moved by the operator horizontally and substantially parallel to the surface to be smoothed, the plane surface, e.g. the edge of the tool, penetrating a few millimeters into the material in order to level the top surface of the viscous material so as to make it plane. The operator assesses the appropriate circular, linear, or arbitrary motion and imparts it to the tool.

Such manual surfacing is thus not strictly reproducible, and gives results that are very unequal in which the quality is usually associated with the experience of the operator. Furthermore, it is not possible to perform such an operation within a hostile environment in which an operator should not be present, in particular in an environment that is radioactive.

SUMMARY OF THE INVENTION

An object of the present invention is to solve the drawbacks of the prior art by providing a device that enables the surfacing operation to be automated so as to make this operation reproducible and capable of being performed without an operator intervening in the proximity of the receptacle.

According to the present invention, this object is achieved by a surfacing device for making substantially plane the top surface of a viscous material contained in a receptacle having a bottom wall and a cylindrical vertical side wall whose top edge defines a circular opening, the device being characterized in that it comprises:

- a moving assembly designed to be placed in an operating position relative to said receptacle, in which position said assembly is above said opening;
- first motor means and a first guide system enabling vertical translation movement to be imparted to said assembly relative to said receptacle; and
- variable-speed, second motor means and a second guide system enabling rotary movement to be imparted to a moving subassembly belonging to said assembly; said subassembly comprising:
  - a vertical shaft on the axis of said cylindrical wall when said assembly is in said operating position, the top portion of said shaft being secured to said second motor means; and
  - a rule connected to the bottom portion of said shaft, the rule being of length substantially equal to the radius of said opening and having a bottom surface presenting a horizontal longitudinal portion for smoothing the top surface of the viscous material, said rule penetrating through said opening into said viscous material during a first stage in which the first motor means are activated to lower said assembly, said rule being set into rotation during a second stage during which the first motor means are activated to cause said assembly to rise.

It will thus be understood that the first motor means make it possible to raise or lower the major portion of the device, including the rule which constitutes the surfacing tool, and that the variable-speed, second motor means make it possible to rotate the rule and the portion of the device which is secured thereto so as to perform a circular movement that performs smoothing in automatic manner.

Furthermore, combining the raising movement and the rotation of the rule during the second stage makes it possible to perform surfacing in a plurality of passes, and at regularly increasing heights, such that when the rule is no longer in contact with the surface all of the material has been uniformly distributed and there is no need to remove surplus material, and consequently no need to clean off any splashes.

In an advantageous disposition, said subassembly also includes an arm fixed to said bottom portion of the shaft and extending diametrically over said opening when in said operating position, one end portion of the arm being connected to said rule and the other end portion being connected to a balancing system ensuring that the longitudinal portion of the bottom surface of said rule is horizontal.

In another particularly advantageous configuration, said subassembly further includes a vibrator system connected to said rule so as to add vertical oscillatory motion to said rule during rotation thereof, and a damping system placed between the arm and said rule to avoid transmitting the vibration that results from oscillation of the rule to the remainder of said device.

In this case, and preferably, said vibrator system comprise a pneumatic vibrator secured to said rule and fed by a compressed air circuit comprising a compressed air source, an angled feed tube having an upstream segment connected to said source, a rotary coupling connecting the downstream segment of said tube to the top portion of said shaft, a longitudinal channel passing along said shaft, and a flexible tube connecting the bottom end of said channel to said vibrator, and said damper system has resilient studs.

The present invention also provides a surfacing method using the above-defined device and characterized in that it comprises the following steps:

- said device is positioned in such a manner as to place said assembly in its operating position over the opening of said receptacle, the shaft lying on the axis of said receptacle, the rule being above a radius of said opening;
- a first stage is performed during which said first motor means are activated to lower said assembly until said longitudinal portion of the rule has penetrated into said viscous material; and
- a second stage is performed during which said second motor means are activated to set said rule into rotation and during which said first motor means are activated to cause said assembly to rise at least until said longitudinal portion of the rule has moved out from the viscous material.

In particularly advantageous manner, the said second stage is a stage during which said second motor means are initially activated to set said rule into rotation at a first speed of rotation, and subsequently said second motor means are activated to cause said rule to rotate at a second speed of rotation slower than said first speed of rotation.

The invention also provides the use of the surfacing device of the above type for a receptacle, preferably made of concrete, which contains said viscous material, preferably concrete, and at least one box containing contaminated waste for subsequent long-duration storage, where said viscous material was cast into said receptacle during vibration of a vibrating table which vibrates with vertical acceleration and on which said receptacle was retained.

The invention will be better understood and secondary characteristics and advantages thereof will appear on reading the following description of an embodiment given by way of example.

It should be understood that the description and the drawings are given purely by way of non-limiting indication.

BRIEF DESCRIPTION OF THE DRAWINGS

Reference is made to the accompanying drawings, in which.

DETAILED DESCRIPTION OF THE PRESENT PREFERRED EMBODIMENTS

Figure 1:
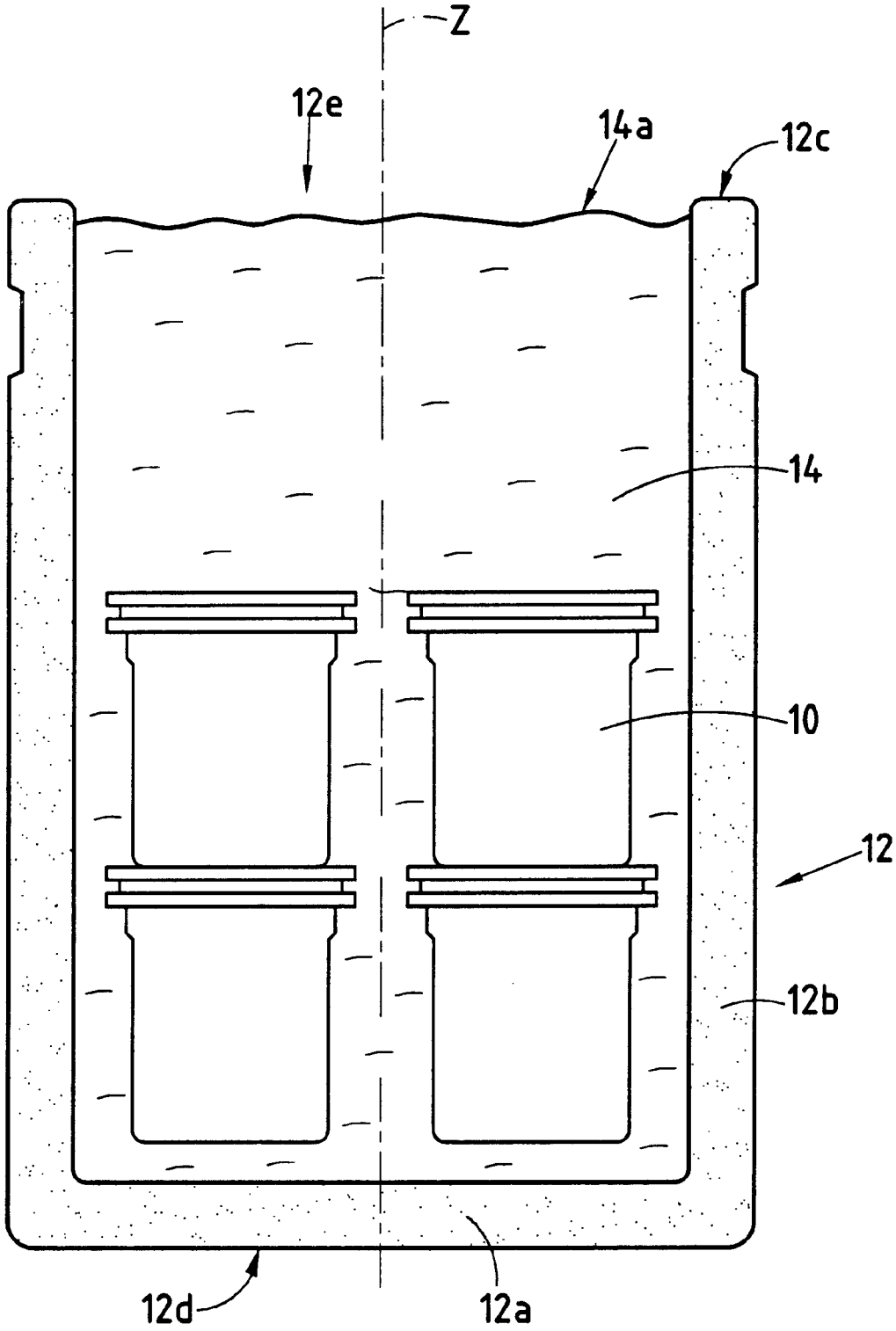
FIG. 1 is a longitudinal section view through a receptacle containing a viscous material whose top surface is to be smoothed.

The embodiment shown relates to the use of the surfacing device described below for a receptacle that is used in the nuclear industry to package contaminated technological waste by encasing it in fiber concrete. The waste in question is initially placed in boxes 10 specially designed for this purpose which are stacked inside a cylindrical container or receptacle 12, preferably likewise made of fiber concrete.

The boxes 10 are embedded in a mass of very viscous material 14, preferably fiber concrete, which has previously been cast into the receptacle up to a level that is nearly flush with the top edge 12*c* of the receptacle 12.

The receptacle 12 has a bottom wall 12*a* and a cylindrical side wall 12*b*, and it rests via the bottom face 12*d* of the bottom wall 12*a* on a support whose planeness is at least of the same quality as the planeness of the face 12*d*.

After the concrete has been cast, the top level 14*a* thereof is situated no more than a few centimeters below the annular top free edge 12*c* of the receptacle 12.

In this application, the surface state of the concrete at its surface 14*a* must be good so as to enable a series of receptacles 12 to be superposed in a stack and so as to guarantee that there are no defects or damage to the surface 14*a* of the concrete once it has set. Such a defect could compromise long-term leakproofing of the receptacle 12, given that it is designed to be stored for several hundred years.

After the concrete has completely solidified, it is the top surface 14*a* of the concrete 14 which constitutes the top surface of the receptacle, and no lid is required. Thus, if this top surface 14*a* has roughnesses or surface irregularities, they run the risk of giving rise to cracking phenomena, e.g. after liquid has infiltrated.

It is not possible to surface this surface 14*a* manually because of the radioactivity of the waste enclosed in the boxes 10, so this operation must be capable of being performed automatically under remote control.

Prior to the surfacing step, concrete 14 is cast into the receptacle 12 while the receptacle 12 is secured to a vibrating table so as to avoid leaving any bubbles of air inside the concrete. If, after filling, it is judged that there is an excess quantity of concrete present in the receptacle 12, provision is made for the receptacle 12 to pass through a scraping station prior to the surfacing operation so as to remove the surplus concrete, i.e. more or less all of the concrete which projects above the top edge 12*c* of the receptacle 12.

Figure 2:
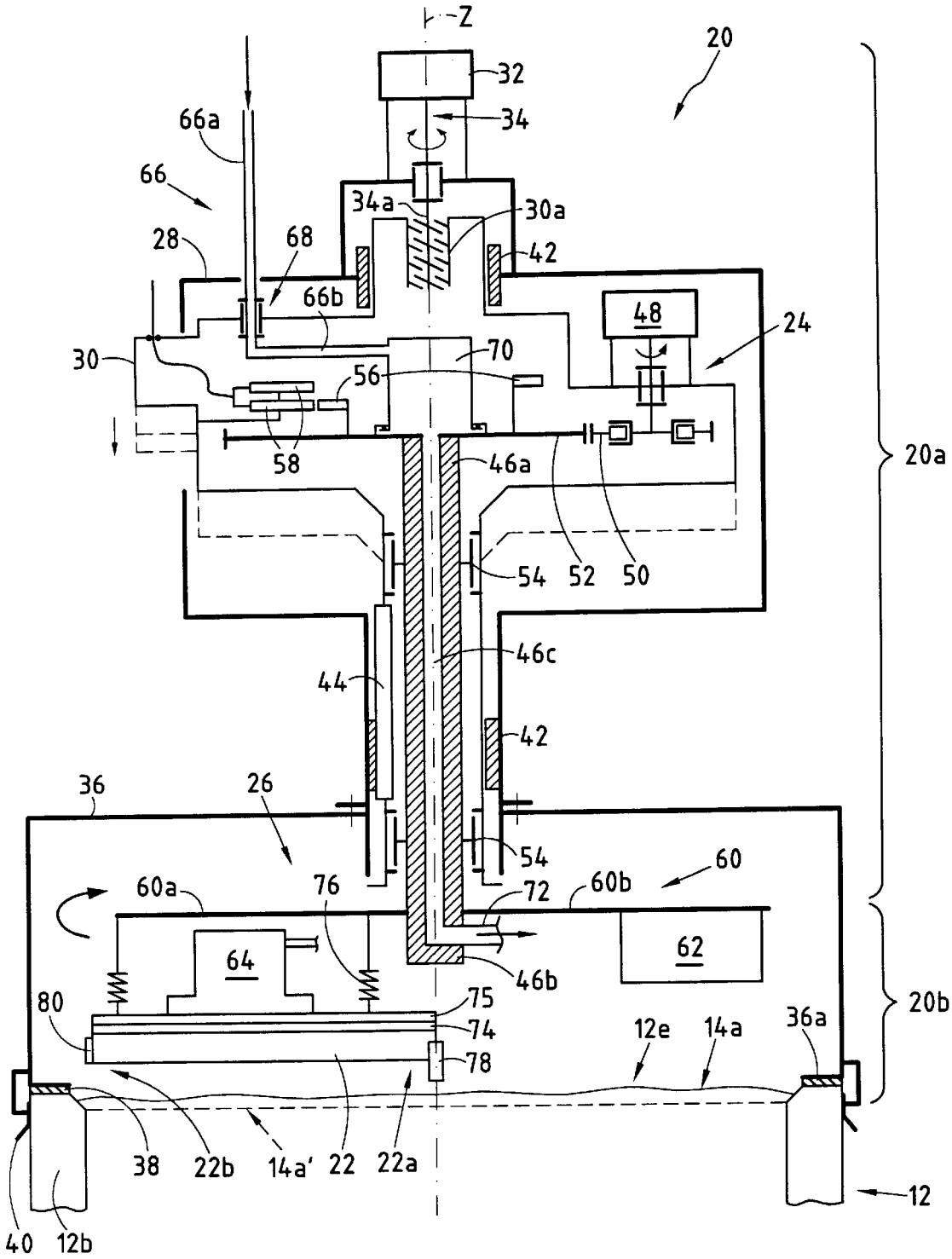
FIG. 2 is a diagrammatic longitudinal section through a surfacing device of the present invention positioned above the receptacle of FIG. 1.

Reference is now made to FIG. 2 which is a diagram showing the surfacing device 20 of the present invention placed in its operating position over a receptacle 12.

The surfacing device 20 has a top portion 20*a* corresponding to an assembly of motor and guide elements which are advantageously remotely controlled and which make it possible simultaneously or successively to perform vertical translation movement and rotary movement as described below. The bottom portion 20*b* of the device 20 has all of the elements that enable the rule to be positioned correctly and for it to have the most appropriate movement for ensuring that at the end of the surfacing operation the top surface 14 of the concrete is as plane as possible, i.e. as smooth as possible.

Operation is based on the following principle: a rule 22 is placed above the receptacle 12 overlying a radius of its opening 12*e*, the length of the rule being substantially equal to the inside radius of the receptacle 12 and the rule having a special profile which is described below. The rule 22 is set into rotation about the axis Z of the receptacle 12 while the bottom surface of the rule is situated a few millimeters beneath the surface 14*a* of the concrete so as to spread out the quantity of concrete that lies above this level. While the rule 22 is rotating, the present device operates on the principle that the rule is progressively raised vertically until it has been raised completely out from the concrete so as to obtain a surface 14*a'* that is plane. Preferably, the rule is raised in two stages (roughing and finishing) corresponding to two respective speeds of rotation: fast (working speed) and slow (finishing speed).

To impart those two movements to the rule 22, the device 20 has an assembly of elements forming an assembly that is movable in vertical translation, with a portion of this moving assembly 24 constituting a subassembly 26 which is also movable in rotation.

As can be seen in FIG. 2, the device 20 further comprises a housing 28 having an open bottom portion which is placed in stationary manner essentially over the opening 12*e* of the receptacle 12 in said operating position shown in FIG. 2. The housing 28 houses at least part of said moving assembly 24 which is provided with a case 30 that is movable in vertical translation relative to the housing 28 and houses the top portion of the subassembly 26. The housing 28 and the case 30 form two hollow all-welded elements that are engaged one within the other.

In order to enable the moving assembly 24 to move in vertical translation relative to the housing 28, the device has first motor means in the form of a stepper motor 32 mounted at the top of said housing 28 and having a vertical outlet shaft 34 whose free end 34*a* is threaded and co-operates with a nut-forming top portion 30*a* of the case 30.

The bottom portion of the housing 28 is extended by a bell 36 which closes the opening 12*e* of the receptacle 12 by covering it. The bell 36 thus constitutes the bottom portion of the housing, forming a lid for the receptacle 12 above the rule 22 and having a circular bottom edge 36*a* connected to the side wall 12*b,* sealing means being placed between the bottom edge 36*a* of said bottom portion 36 and said side wall 12. In the embodiment shown in FIG. 2, the bottom edge 36*a* of the bell 36 has a diameter that is equal to the diameter of the top edge 12*c* of the receptacle 12, with sealing being provided by a flat annular compressible gasket 38 that is compressed between the facing edges of the bell 36 and the receptacle 12.

Centering means are also provided for centering said housing 28 so as to place the housing 28 in its operating position relative to the receptacle 12: this function is performed by centering tabs 40.

A first guide system defines vertical translation movement between the housing 28 and the moving assembly 24 by the presence of at least one bearing 42 placed between the inside surface of the housing 28 and the outside surface of the case 30. Preferably, and as shown in FIG. 2, the device 20 has two bearings 42 situated respectively at the top and at the bottom of the top portion 20*a* of the device 20.

In order to prevent any rotation between the case 30 and the housing 28, a key 44 is placed between them.

Thus, under drive from the stepper motor 32, rotation of the threaded free end 34*a* of the shaft 34 causes the case 30 to move in vertical translation together with all of the elements it contains and which are secured thereto. This applies to the shaft 46 extending axially along the axis Z of the receptacle 12 when the device 20 is in the operating position, the rule 22 being connected to the bottom portion 46*b* of the shaft 46 where it penetrates inside the bell 36. The top portion 46*a* of the shaft 46 is connected to means for setting it into rotation and comprising second motor means secured to the case 30 and co-operating with a second guide system to impart rotary motion between said subassembly 26 and the case 30, the shaft 46 being rotatably mounted in the case 30.

The second motor means comprise a motor and gear box unit 48 comprising a motor driving a vertical axis speed-reducing gear box which rotates a vertical axis gear 50.

The gear 50 meshes with a toothed wheel 52 coaxial about said shaft 46 and fixed around the top portion 46*a* of said shaft 46.

The toothed wheel 52 has a number of teeth that is determined so as to obtain the desired stepdown ratio between the wheel 52 and the gear 50.

In order to guide rotation of the shaft 46, a second guide system is provided comprising at least one roller bearing 54, preferably a conical roller bearing which is placed between said shaft 46 and said case 30. In the embodiment shown, two roller bearings 54 are placed along the shaft 46. These roller bearings 54 prevent any lateral movement relative to the case 30 of the shaft 46 or any of the elements which are attached thereto and which together form the subassembly 26.

Advantageously, the device also comprises means for detecting the angular position of said subassembly 26 relative to the case 30 using an encoding ring 56 fixed to the wheel 52 and carrying markers at two different heights which are regularly distributed around the circumference of the ring 56. Two inductive proximity detectors 58 are placed in register with the ring 56 so as to observe the passage of a marker past one of the detectors 58. The makers and the detectors 58 form a logic assembly making it possible to determine at all times the number of revolutions that have been performed by the shaft 46, i.e. by the rule 22.

With reference to the bottom portion 20*b* of the device 20, the bottom portion 46*b* of the shaft is connected to a horizontal arm 60, the shaft being centered on said arm 60. A first end portion 60*a* (on the left in FIG. 2) is connected via a support system to the rule 22, and the second end portion 60*b* of the arm 60 (on the right in FIG. 2) is connected to a balancing system in the form of a counter-weight 62 designed to guarantee that the arm 60 remains horizontal so as to keep the rule 22 likewise horizontal without giving rise to unbalance at the bottom portion of the shaft 46.

Advantageously, the device 20 also has a pneumatic vibrator 64 designed to impart vertical oscillating motion to the rule 22 while it is rotating, these oscillations making it possible to improve the final surface state of the concrete 14 to a considerable extent. In order to feed the vibrator 64 with compressed air from the top portion 20*a,* a compressed air circuit is provided which reaches the device 20 via an angled feed tube 66 having an upstream segment 66*a* that is vertical and in fluid communication with a source of compressed air, passing through the top wall of the housing 28 in sliding manner and forming a pivot link 68 with the top wall of the case 30.

The downstream segment 66*b* of the feed tube 66 is connected to a rotary coupling 70 placed coaxially on top of the top portion 46*a* of the shaft 46 which has a longitudinal channel 46*c* that opens out in the bottom portion 46*b* of the shaft 46 into a flexible tube 72 whose other end is connected to the vibrator 64.

The rule 22 is fixed beneath an adjustable plate 74 which can slide against a fixed plate 75 located above the plate 74 by means of a screw (not shown) with the assembly forming means for adjusting the radial position of the rule 22 relative to the shaft 46.

The vibrator 64 is placed above the fixed plate 75 which is connected to the arm 60 via four resilient studs 76 forming a damping system to attenuate the transmission of vibration from the vibrator to the other elements of the device 20.

Before performing a surfacing operation, the position of the rule 22 is finely adjusted so that its radially inner end 22*a* is centered relative to the opening 12*e* of the receptacle 12, i.e. lies on the axis Z. This radially inner end 22*a* is provided with a peg 78 which is placed on the axis Z of the receptacle 12 when the device 20 is in its operating position, said peg 78 projecting down from the rule 22. During the first stage in which said assembly is lowered, the peg 78 forms a depression in the top surface 14*a* of the concrete, which depression is progressively filled with concrete during the second stage while said rule 22 is rising so as to be able to use the residues which accumulate in the center of the surface, and thus avoiding forming a central buildup of material which would be unacceptable.

Figure 3:
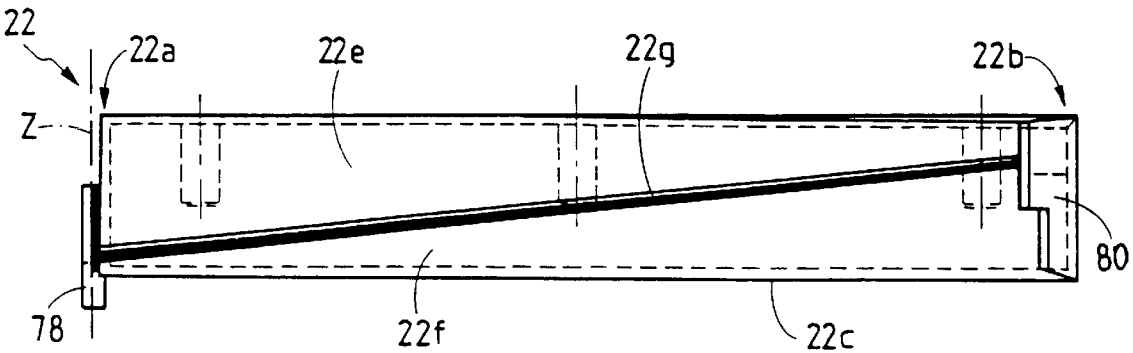
FIG. 3 is an elevation view of the surfacing rule shown as seen from behind the sheet of FIG. 2.
Figure 4:
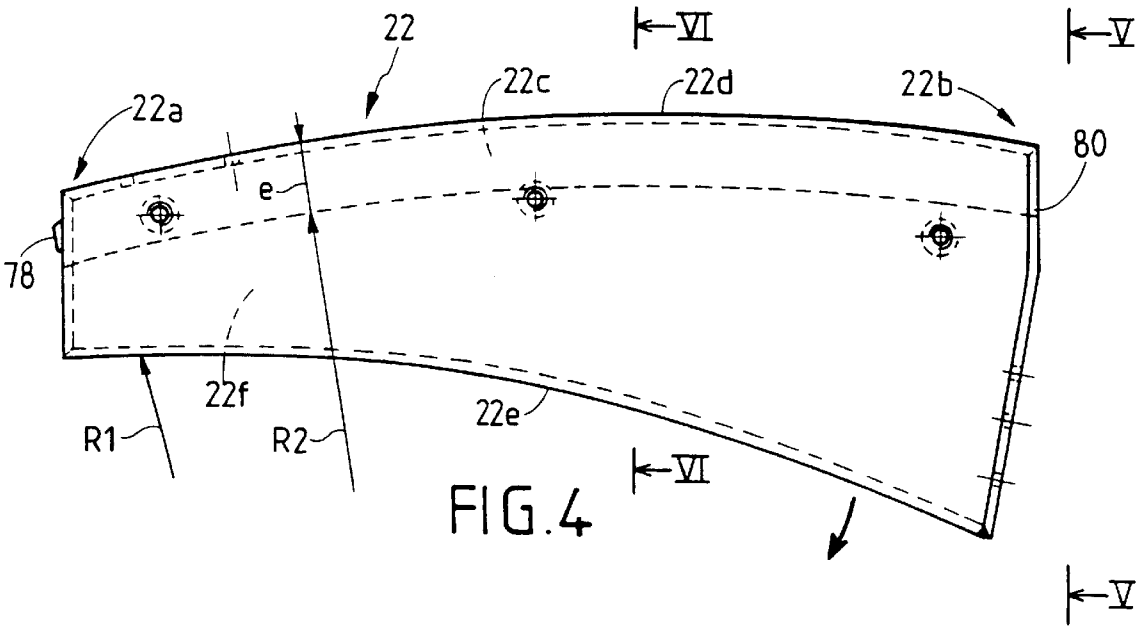
FIG. 4 is a plan view of the FIG. 3 rule.
Figure 5:
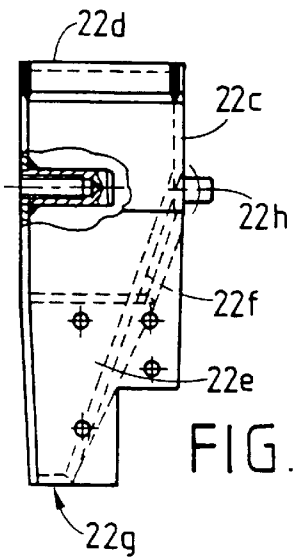
FIG. 5 is a view of the rule seen in direction V—V of FIG. 4.

For the shape of the rule 22, Reference is made more particularly to FIGS. 3 to 5.

The radially outer end 22*b* of the rule 22 is provided with a gasket 80 of elastomer material which extends the rule radially and which is designed to come into contact with the inside face of the side wall 12*b* of the receptacle 12 so as to prevent material rising at this point.

The rule 22 has a horizontal longitudinal portion 22*c* defined by an outline which forms a segment of a ring having an inside radius R2 and a ring width e. This horizontal portion 22*c* is adjacent to and defined by a rear vertical wall 22*d*.

The horizontal portion 22*c* is extended towards the vertical front wall 22*e* by a sloping portion 22*f* rising from the horizontal portion 22*c* towards the side wall of the rule 22 that forms the front wall 22*e* while the rule 22 is rotating. As can be seen more precisely in FIG. 3, the front edge 22*g* of the sloping portion 22*f* forms a line that rises from the radially inner end 22*a* of the rule towards the radially outer end 22*b* thereof, said front edge 22*g* forming a circular arc of radius R1 in horizontal projection (FIG. 4) and a straight line in vertical projection (FIG. 3). The rear edge 22*h* of the sloping portion 22*f* adjacent to the horizontal portion 22*c* forms a circular arc of radius R2, where R2 is greater than R1.

Figure 6:
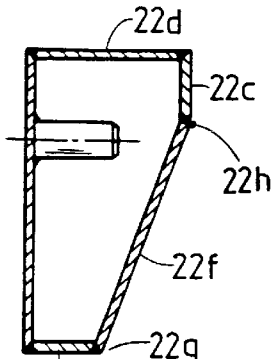
FIG. 6 is a section view in direction VI—VI of the FIG. 4 rule.

Thus, with reference to FIG. 6, it can be seen that the rule 22 has a cross-section in the form of a five-sided polygon corresponding to a rectangle whose vertex between the front wall 22*e* and the horizontal wall 22*c* is truncated so as to form the sloping portion 22*f*.

Thus, while the rule 22 is rotating in the direction given by the arrow in FIG. 4, concrete is entrained from the center of the rule 22 towards its periphery so that the excess concrete thickness is progressively flattened and spread while the rule is rotating, going away from the center of the surface 14*a* towards the periphery of the surface 14*a*.

The very particular profile of the rule 22 serves to make the relative travel speeds between the center 22*a* and the periphery 22*b* of the rule 22 more uniform relative to the receptacle 12.

While the rule 22 is being raised, it rotates initially at a first speed of rotation of the motor and gear box unit 48 so as to rough out the surface 14*a*, after which the speed of rotation of the rule 22 is diminished before the rule has been raised out from the concrete so as to perform a finishing step over a plurality of revolutions of the rule 22 which continues to rotate while moving upwards so as to have less and less concrete pushed back by the sloping portion 22*f* and so as finally to reach a position in which the horizontal portion 22*c* is flush with the plane top surface 14*a'* of the concrete.

Thereafter, it suffices to disengage the receptacle 12 from the device 20 by separating them from each other in order to proceed with the following step which corresponds to allowing the concrete 14 to dry and set.

The surfacing device 20 as described above is preferably associated with:

- a system for automatically rinsing the bell 36, which system serves between two surfacing operations to remove any dirt and/or splashes that may be present on the inside wall of the bell 36 and on the rotary elements present within the bell, and in particular the surfacing rule 22; and
- a remote surveillance system including cameras, some of which serve to monitor the surface state of the concrete during and at the end of smoothing; this remote surveillance system enables the operator to follow in detail how the surfacing is progressing so as to be able to stop it, should that be necessary.

What is claimed is:

1. A surfacing method for making substantially plane the top surface of a viscous material contained in a receptacle having a bottom wall and a cylindrical vertical side wall whose top edge defines a circular opening, said method comprising the following steps:

providing a device comprising:

a moving assembly designed to be placed in an operating position relative to said receptacle in which position said assembly is above said opening, said assembly having a subassembly comprising a vertical shaft that is aligned with a center of said circular opening when said assembly is in said operating position, and a rule connected to the bottom portion of said shaft, the rule being of length substantially equal to the radius of said opening and having a bottom surface presenting a horizontal longitudinal portion for smoothing the top surface of the viscous material;

first motor means and a first guide system enabling vertical translation movement to be imparted to said assembly relative to said receptacle; and variable-speed, second motor means and a second guide system enabling rotary movement to be imparted to said moving subassembly, the top portion of said shaft being secured to said second motor means and, in operation when said second motor means are activated;

positioning said device in such a manner as to place said assembly in its operating position over the opening of said receptacle, the shaft lying on the axis of said receptacle, the rule being above a radius of said opening;

performing a first stage during which said first motor means are activated to lower said assembly until said longitudinal portion of the rule has penetrated into said viscous material; and performing a second stage during which said second motor means are activated to set said rule into rotation and during which said first motor means are activated to cause said assembly to rise at least until said longitudinal portion of the rule has moved out from the viscous material.

2. A surfacing method according to claim 1, wherein said second stage is a stage during which said second motor means are initially activated to set said rule into rotation at a first speed of rotation, and subsequently said second motor means are activated to cause said rule to rotate at a second speed of rotation slower than said first speed of rotation.

3. A method for using a surfacing device to make substantially plane the top surface of a viscous material contained in a receptacle having a bottom wall and a cylindrical vertical side wall whose top edge defines a circular opening, said method comprising the steps of:

providing a device comprising:

a moving assembly designed to be placed in an operating position relative to said receptacle in which position said assembly is above said opening, said assembly having a subassembly comprising a vertical shaft that is aligned with a center of said circular opening when said assembly is in said operating position, and a rule connected to the bottom portion of said shaft, the rule being of length substantially equal to the radius of said opening and having a bottom surface presenting a horizontal longitudinal portion for smoothing the top surface of the viscous material;

first motor means and a first guide system enabling vertical translation movement to be imparted to said assembly relative to said receptacle; and variable-speed, second motor means and a second guide system enabling rotary movement to be imparted to said moving subassembly, the top portion of said shaft being secured to said second motor means and, in operation when said second motor means are activated;

providing, in said receptacle, said viscous material and at least one box containing contaminated waste for subsequent long-duration storage thereof;

retaining said receptacle on a vibrating table which vibrates with vertical acceleration;

positioning said device in such a manner as to place said assembly in its operating position over the opening of said receptacle, the shaft aligning with the center of said circular opening, the rule being above a radius of said opening;

performing a first stage during which said first motor means are activated to lower said assembly; and performing a second stage during which said second motor means are activated to set said rule into rotation, during which said vibrating table is vibrated to cast said viscous material into said receptacle and during which said first motor means are activated to cause said assembly to rise.

4. A surfacing device for making substantially plane the top surface of a viscous material contained in a receptacle having a bottom wall and a cylindrical vertical side wall whose top edge defines a circular opening, the device comprising:

a moving assembly designed to be placed in an operating position relative to said receptacle in which position said assembly is above said opening, said assembly having a subassembly comprising a vertical shaft that is aligned with a center of said circular opening when said assembly is in said operating position, and a rule connected to the bottom portion of said shaft, the rule being of length substantially equal to the radius of said opening and having a bottom surface presenting a horizontal longitudinal portion for smoothing the top surface of the viscous material, said bottom surface of the rule having a sloping portion that rises from the horizontal portion towards a side wall of the rule that forms a front wall during rotation of said rule, the front edge of the sloping portion forming a line that rises from the radially inner end towards the radially outer end of said rule;

first motor means and a first guide system enabling vertical translation movement to be imparted to said assembly relative to said receptacle; and variable-speed, second motor means and a second guide system enabling rotary movement to be imparted to said moving subassembly, the top portion of said shaft being secured to said second motor means and, in operation when said second motor means are activated, said rule penetrating through said opening into said viscous material during a first stage in which the first motor means are activated to lower said assembly, said rule being set into rotation during a second stage during which the first motor means are activated to cause said assembly to rise.

5. A device according to claim 4, wherein said subassembly further includes an arm fixed to said bottom portion of the shaft and extending diametrically over said opening when in said operating position, one end portion of the arm being connected to said rule, and a balancing system connected to the other end portion of the arm and ensuring that the longitudinal portion of the bottom surface of said rule is horizontal.

6. A device according to claim 5, wherein said subassembly further includes a vibrator system connected to said rule so as to add vertical oscillatory motion to said rule during rotation thereof, and a damping system placed between the arm and said rule to avoid transmitting the vibration that results from oscillation of the rule to the remainder of said device.

7. A device according to claim 6, wherein said vibrator system comprises a pneumatic vibrator secured to said rule and a compressed air circuit comprising a compressed air source to feed said pneumatic vibrator, an angled feed tube having an upstream segment connected to said source, a rotary coupling connecting the downstream segment of said tube to the top portion of said shaft, a longitudinal channel passing along said shaft, and a flexible tube connecting the bottom end of said channel to said vibrator, and wherein said damper system has resilient studs.

8. A device according to claim 5, wherein said subassembly also includes means for adjusting the radial position of said rule relative to said shaft.

9. A device according to claim 4, wherein said device also comprises a housing having an open bottom portion, which is disposed, when in said operating position, in stationary manner essentially over the opening of the receptacle, and in which at least part of said moving assembly including a case is housed, in that the top portion of said subassembly is housed in said case, in that said first motor means and said first guide system impart the vertical translation movement between said housing and said assembly, in that said second motor means are secured to said case in such a manner that in co-operation with said second guide system they impart rotary motion between said subassembly and said case, and in that said shaft is rotatably mounted in said case.

10. A device according to claim 9, wherein said housing has a bottom portion forming a lid for said container, the bottom portion being placed over said rule and having a circular bottom edge connected to said side wall, and in that sealing means are placed between the bottom edge of said bottom portion and said side wall.

11. A device according to claim 9, wherein it further comprises means for centering said housing, enabling said housing to be placed in the operating position relative to said receptacle in such a manner that said shaft lies on the axis of said side wall of the receptacle.

12. A device according to claim 9, wherein it further comprises means for detecting the angular position of said subassembly relative to the case.

13. A device according to claim 9, wherein said first motor means comprise a stepper motor mounted at the top of said housing and having a vertical outlet shaft whose free end is threaded and co-operates with the top portion of said case which forms a nut, and wherein said first guide system includes at least one bearing between the bottom surface of said housing and the outer surface of said case.

14. A device according to claim 9, wherein said subassembly further includes a toothed wheel coaxial about said shaft and fixed around the top portion of said shaft, wherein said second motor means comprise a motor driving a vertical-axis speed-reducing gear box which rotates a gear which meshes with said toothed wheel, and wherein said second guide system comprises at least one roller bearing placed between said shaft and said case.

15. A device according to claim 4, wherein said front edge forms a circular arc of radius R1 and wherein said sloping portion presents a rear edge adjacent to said horizontal portion and forming a circular arc of radius R2>R1.

16. A device according to claim 4, wherein said radially inner end of said rule is centered relative to said opening and is provided with a peg projecting downwards and lying on the same axis as said shaft, said peg acting during the first stage to create a depression in the top surface of the concrete, said depression being progressively filled with said viscous material during the rising, second stage of said rule.

17. A device according to claim 4, wherein the radially outer end of said rule is extended radially by an elastomer gasket designed to come into contact with the inside face of the side wall of said receptacle.

* * * * *